US009927175B2

(12) United States Patent
Mnikoleiski et al.

(10) Patent No.: US 9,927,175 B2
(45) Date of Patent: Mar. 27, 2018

(54) MONITORING METHOD

(75) Inventors: Hans-Peter Mnikoleiski, Duisburg (DE); Detlef Maiwald, Moers (DE); Wolfgang Uhrig, Laubach-Gonterskirchen (DE); Frank Heinke, Weimar (DE); Domenico Di Lisa, Duisburg (DE); Andreas Himmelreich, Golmsdorf (DE)

(73) Assignee: INNOVATHERM PROF. DR. LEISENBERG GMBH + CO. KG, Butzbach (DE)

( * ) Notice: Subject to any disclaimer, the term of this patent is extended or adjusted under 35 U.S.C. 154(b) by 996 days.

(21) Appl. No.: 14/347,699

(22) PCT Filed: Sep. 29, 2011

(86) PCT No.: PCT/EP2011/067034
§ 371 (c)(1),
(2), (4) Date: May 20, 2014

(87) PCT Pub. No.: WO2013/044968
PCT Pub. Date: Apr. 4, 2013

(65) Prior Publication Data
US 2014/0255860 A1 Sep. 11, 2014

(51) Int. Cl.
*F27B 13/14* (2006.01)

(52) U.S. Cl.
CPC ..... *F27B 13/14* (2013.01)

(58) Field of Classification Search
USPC ..... 432/19, 24
See application file for complete search history.

(56) References Cited

U.S. PATENT DOCUMENTS 4,336,227 A * 6/1982 Koyama ..... B01J 8/1809 110/245
2011/0017423 A1* 1/2011 Leisenberg ..... F27B 13/02 165/47

FOREIGN PATENT DOCUMENTS

EP 1 785 685 5/2007

OTHER PUBLICATIONS

International Search Report dated May 16, 2012 for International Application No. PCT/EP2011/067034.

(Continued)

*Primary Examiner* — Steven B McAllister
*Assistant Examiner* — Ko-Wei Lin
(74) *Attorney, Agent, or Firm* — Quarles & Brady LLP

(57) ABSTRACT

The invention relates to a method for monitoring an operating status of an anode furnace, wherein the anode furnace is formed from a plurality of heating ducts (12) and furnace chambers, wherein the furnace chambers serve for receiving anodes and the heating ducts serve for controlling the temperature of the furnace chambers, wherein the anode furnace comprises at least one furnace unit (11) having a heating zone (18), a firing zone (19) and a cooling zone (20), wherein a suction device (15) is arranged in the heating zone and a burner device (16) is arranged in the firing zone, wherein, by means of the burner device, combustion air is heated up in the heating ducts of the firing zone, wherein, by means of the suction device, hot air is sucked out of the heating ducts of the heating zone, wherein a suction output of the suction device is determined, and wherein a pressure in the heating duct is measured, wherein a volumetric flow in the heating duct is determined from a ratio of suction output and pressure.

15 Claims, 5 Drawing Sheets

(56) References Cited

OTHER PUBLICATIONS

Mannweiler, Ulrich, et al., "Process Control in an anode bake furnace fired with heavy oil," Light Metals, Feb. 17-21, 1991, pp. 667-671, vol. Meeting 120, Proceedings of the TMS Annual Meeting, New Orleans, U.S.A.

English Language Translation of the PCT International Preliminary Report on Patentability, Application No. PCT/EP2011/067034, dated Apr. 10, 2014, 8 pages.

* cited by examiner

Fig. 4
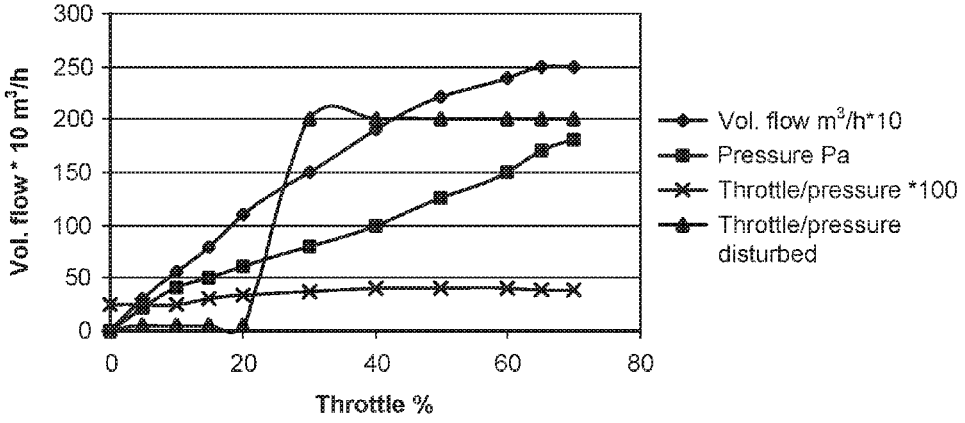
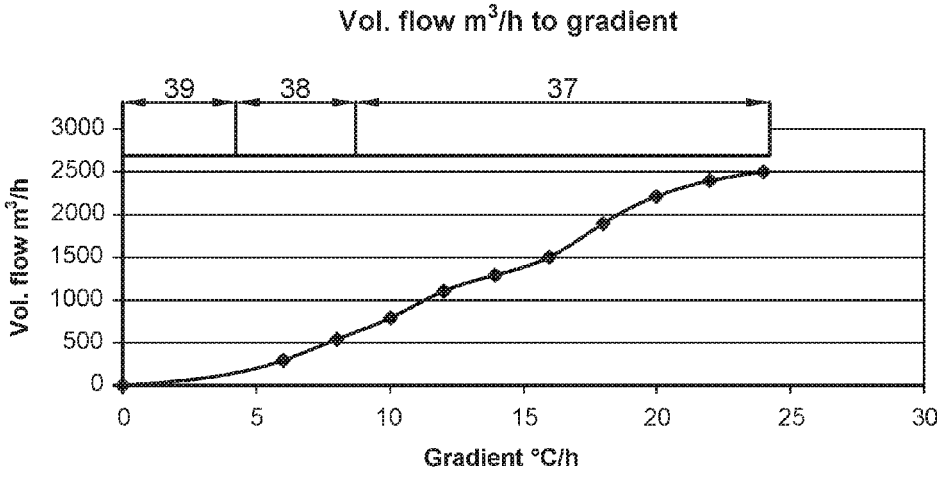
Fig. 5

MONITORING METHOD

CROSS-REFERENCE TO RELATED APPLICATIONS

This application represents the national stage entry of PCT International Application No. PCT/EP2011/067034 filed Sep. 29, 2011. The contents of this application are hereby incorporated by reference as if set forth in its entirety herein.

BACKGROUND

The invention relates to a method for monitoring an operating status of an anode furnace, wherein the anode furnace is formed from a plurality of heating ducts and furnace chambers, wherein the furnace chambers serve for receiving anodes and the heating ducts serve for controlling the temperature of the furnace chambers, wherein the anode furnace comprises at least one furnace unit having a heating zone, a firing zone and a cooling zone, wherein a suction device is arranged in the heating zone and a burner device is arranged in the firing zone, wherein, by means of the burner device, combustion air is heated up in the heating ducts of the firing zone, and wherein, by means of the suction device, hot air is sucked out of the heating ducts of the heating zone.

The present method is applied in the production of anodes that are required for fused-salt electrolysis for the production of primary aluminum. These anodes are produced in a molding procedure as so-called "green anodes" or "raw anodes", from petroleum coke, to which pitch is added as a binding agent, the anodes being sintered in an anode furnace subsequently to the molding procedure. This sintering process is realized in a heat treatment process which takes place in a defined manner, and during which the anodes pass through three phases, namely a heating phase, a sintering phase and a cooling-down phase. In this case, the raw anodes are situated in a heating zone of a "fire" that is composed of the heating zone, a firing zone and a cooling zone and that is formed in the anode furnace, the raw anodes being pre-heated by the waste heat of already fully sintered anodes that originates from the firing zone, prior to the pre-heated anodes being heated to the sintering temperature of approximately 1200° C. in the firing zone. According to the state of the art as it is known, for example, from the document EP 1 785 685 A1, the different above-described zones are defined by an alternately continuous arrangement of different modules above furnace chambers or heating ducts that receive the anodes.

The firing zone, which is arranged between the heating zone and the cooling zone, is defined by positioning a burner device above selected furnace chambers or heating ducts. Anodes that have been burned directly prior thereto, which means that have been heated to the sintering temperature, are situated in the cooling zone. Above the cooling zone, a blower device is arranged, by means of which air is blown into the heating ducts of the cooling zone. By means of a suction device that is arranged above the heating zone, the air is guided, via the heating ducts, from the cooling zone through the firing zone into the heating zone, and, from the latter, in the form of flue gas, guided through a flue gas cleaning system, being released into the surroundings. The suction device and the burner device form a furnace unit together with the blower device and the heating ducts.

The above-described modules are shifted at regular time intervals along the heating ducts in the direction of the raw anodes that are arranged in the anode furnace. In this way, there can be provision for an anode furnace comprising several furnace units, the modules of which are shifted, subsequently to one another, above the furnace chambers or heating ducts for subsequent heat treatment of the raw anodes or anodes. In case of such anode furnaces, which can be embodied as open anode furnaces or annular anode furnaces in different designs, there is the problem that a volumetric flow of the air, which is channeled through the anode furnace, can only be measured with an unjustifiably high complexity. Determining the volumetric flow is in particular required for regularly monitoring an operating status of an anode furnace. In this way, it is to be ensured that sufficient oxygen for combusting a combustible material of the burner device is available in the heating ducts of the anode furnace. Since, due to the meander-shaped rectangular geometry of the heating ducts, a direct volumetric flow measurement is not possible, an attempt is made to determine the volumetric flow by an indirect measurement, for example a pressure measurement. Such an estimation of the volumetric flow, however, often leads to useless results if, for example, a heating duct covering is open or improperly closed, or if a heating duct is clogged or blocked. Measuring the volumetric flow by means of a venturi tube also leads to unsatisfactory results since the differential pressures needed for measuring cannot be produced. In practice, a volumetric flow evaluation is therefore performed at regular time intervals by qualified furnace personnel in the course of furnace inspections. If a functional disorder of the anode furnace is detected, the same is manually switched off by the furnace personnel in this case. This can, however, lead to dangerous operating statuses of the anode furnace, which can lead to deflagrations, fires or explosions, possibly not being detected early enough.

SUMMARY

It is therefore the task of the present invention to propose a method for monitoring an operating status of an anode furnace which makes continuous monitoring of the operating status possible.

This task is solved by a method having the features of claim 1.

In the method in accordance with the invention for monitoring an operating status of an anode furnace, the anode furnace is formed from a plurality of heating ducts and furnace chambers, wherein the furnace chambers serve for receiving anodes and the heating ducts serve for controlling the temperature of the furnace chambers, wherein the anode furnace comprises at least one furnace unit having a heating zone, a firing zone and a cooling zone, wherein a suction device is arranged in the heating zone and a burner device is arranged in the firing zone, wherein, by means of the burner device, combustion air is heated up in the heating ducts of the firing zone, wherein, by means of the suction device, hot air is sucked out of the heating ducts of the heating zone, wherein a suction output of the suction device is determined, and wherein a pressure in the heating duct is measured, wherein a volumetric flow in the heating duct is determined from a ratio of suction output and pressure.

The suction output of the suction device can relatively reliably be determined since, although the suction device brings about a volumetric flow in the heating ducts, it is not controlled as a direct function of the volumetric flow. Therefore, a suction output of the suction device is set assuming that the desired volumetric flow will result therefrom. In this way, it is also possible to determine the suction output of the suction device in an easy and precise manner. Furthermore, a pressure or a negative pressure that is brought about by the suction device is measured in the heating duct. The volumetric flow in the heating duct can comparatively precisely be determined from the ratio of the suction output to the pressure. If, for example, a heating duct covering is open or improperly closed or if the heating duct is clogged, a change in the pressure in the heating duct relative to the suction output of the suction arises. The measured pressure in the heating duct, at the same suction output, thus deviates from a presupposed pressure. A reduced or increased volumetric flow in the heating duct can be derived therefrom. The corresponding size of the volumetric flow in each case, at a known suction output and measured pressure, results from a deviation from the presupposed volumetric flow. Since the suction output can be determined continuously and the pressure in the heating duct can be measured continuously, via measuring sensors, which means without furnace personnel, it thus becomes possible, by continuously determining the volumetric flow, to perform the above-mentioned monitoring of the operating status of the anode furnace.

Due to the different embodiments of the method, a pressure or a negative pressure in the heating duct of the heating zone and/or of the firing zone can be measured. In this way, it is conceivable to perform several pressure measurements in the zone in question or in the respective zones in order to quickly ascertain the position of a disruption in operation.

It is further also possible, for determining an operating status in greater detail, to measure a pressure or a negative pressure in, for example, a collecting duct of the suction device. If the suction device is formed in such a manner that it spans several heating ducts in the transverse direction, being connected to the same, the pressure that is measured in said collecting duct can also be used for determining the volumetric flow. Furthermore, it can also be ensured therewith that a functional disorder does not exist if the ratio of the suction output and the measured pressure in the suction device is as expected.

The volumetric flow can be determined even more exactly if the same is determined from a ratio of suction output and pressure in the suction device and from the ratio of suction output and pressure in the heating duct. The ratios in question can be formed separately from each other in each case and the volumetric flow can be derived therefrom.

A volumetric flow can also individually be determined for individual heating ducts, for example in that a respective pressure in a plurality of heating ducts is related to the pressure in the suction device. A pressure in a heating duct, which pressure is particularly high or low in comparison to the remaining heating ducts, can already indicate a potential disruption in operation in the heating duct in question. A pressure deviation in a heating duct furthermore affects the pressures in the remaining heating ducts, such that a volumetric flow that is accordingly changed can be determined or calculated, again having a relative relation to the pressure that has been measured in the suction device.

The suction output of the suction device can be determined by determining a throttle position of a throttle of the suction device. A cross-section of a suction duct can be varied by adjusting the throttle, such that the suction output of the suction device, amongst other things, depends on the set cross-section of the suction duct. If a throttle or a similar device of that type is used, from a throttle position, for example specified as the angular degree relative to the suction duct, conclusions can therefore be drawn on a suction output. A throttle position can be determined in a particularly easy and precise manner, for example, by means of a rotary potentiometer.

It is particularly advantageous if the volumetric flow in the heating duct of the heating zone and/or of the firing zone is determined. Since volumetric flow differences might result, being conditioned by the combustion method, the same can be taken into account in this way. In this way, a volumetric flow in the heating duct of the above-described zones can be determined separately from each other in each case. Thus, a more differenciated consideration of the operating status in the respective zones of the anode furnace becomes possible.

All in all, an operating status can be derived from the ratio of suction output and pressure and/or from the determined volumetric flow. In this way, it becomes possible, with the aid of the measured data or of the volumetric flow, to establish in which phase of the anode production the anode furnace or the furnace unit in question is at the moment. For example, determining the operating status can be utilized for determining a moment for tramming the suction device and the burner device as well as a blower device even more precisely.

In a further embodiment of the method, a temperature in the heating duct can be measured. Thereby, evaluating an operating status is even more facilitated since a required burning temperature can be monitored in this way.

A temperature gradient in the heating duct can furthermore be measured. Accordingly, a temperature progression over a period of time can be monitored, wherein a falling or increasing temperature or a negative or to positive temperature gradient allow conclusions on a change of the operating status.

The temperature gradient and/or the temperature can be measured in a collecting duct of the suction device and/or in the heating zone and/or in the firing zone. The collecting duct or the above-described zones, for proper operation of the furnace unit, respectively require a particular temperature gradient or temperature range, such that, with a monitoring by way of measuring techniques of said system portions, it becomes possible to determine an operating status even more precisely.

The volumetric flow can also be determined even more precisely if a density change of the air in the heating duct is calculated from the temperature gradient and from the temperature, said density change being taken into account during determination of the volumetric flow. The volumetric change of the air that is situated within the heating duct, said change resulting from the temperature in the heating duct increasing or falling, can considerably influence a volumetric flow in the heating duct. A calculation of the volumetric flow can therefore be corrected by a correction factor which can be derived from a calculation of the density change on the basis of the temperature gradient and the temperature.

An operating status can also be derived from a ratio of temperature gradient and volumetric flow. As a function of the volumetric flow in the heating duct, a gradual heating in the heating zone arises. Consequently, a connection between the temperature gradient and the volumetric flow can be established in this way. A temperature gradient in the heating zone that is, for example, negative or very high can, at a low volumetric flow, indicate that the heating duct in question is clogged. By forming a ratio of temperature gradient and volumetric flow, it is therefore even possible to ascertain a potential cause for a disruption in operation.

In this connection, it is advantageous if the operating status is evaluated, wherein, in case of a deviation from a presupposed operating status, the burner device is switched off. In this way, it can be prevented that a functional disorder of the furnace unit entails potential damage of the same. The burner device or the entire furnace unit can also be switched off in an automatical manner, without furnace personnel having to be present. In this respect, there can be provision for the measurement values and operating status sizes that have been recorded in the course of the monitoring method being processed by means of a device for data processing or of a corresponding control device. In this way, the operating status can also automatically be influenced or corrected by an influencing control of the modules in question pertaining to the furnace unit.

Operating status parameters that describe the operating status can also be stored, wherein an evaluation of the current operating status can be performed by comparing the stored operating status parameters to the current ones. In particular if a device for data processing is used, a continuous comparison of the current operating status parameters to the stored operating status parameters can be performed. In this case, it is possible to define threshold values for the different operating status parameters, which values trigger modules to be switched off or to be controlled in a correcting manner.

Advantageously, before each start or initiation of operation or return to operation of the furnace unit, a plausibility check of measuring sensors can be performed. In this way, it can be ensured that the measuring sensors of the furnace unit are connected to one another in the desired way after the modules of the furnace unit have been trammed. Amongst other things, it can also be ensured in this way that the operating status is not undesirably influenced in case of a functional disorder of a measuring sensor.

A preferred embodiment of the invention will be explained in greater detail below in reference to the accompanying drawings.

BRIEF DESCRIPTION OF THE DRAWINGS

In the figures:

FIG. 4: shows a graphic illustration of the ratio of the volumetric flow to the operating status parameters;

FIG. 5: shows a graphic ratio illustration of the volumetric flow to the temperature gradient;

DETAILED DESCRIPTION OF THE DISCLOSURE

Figure 1:
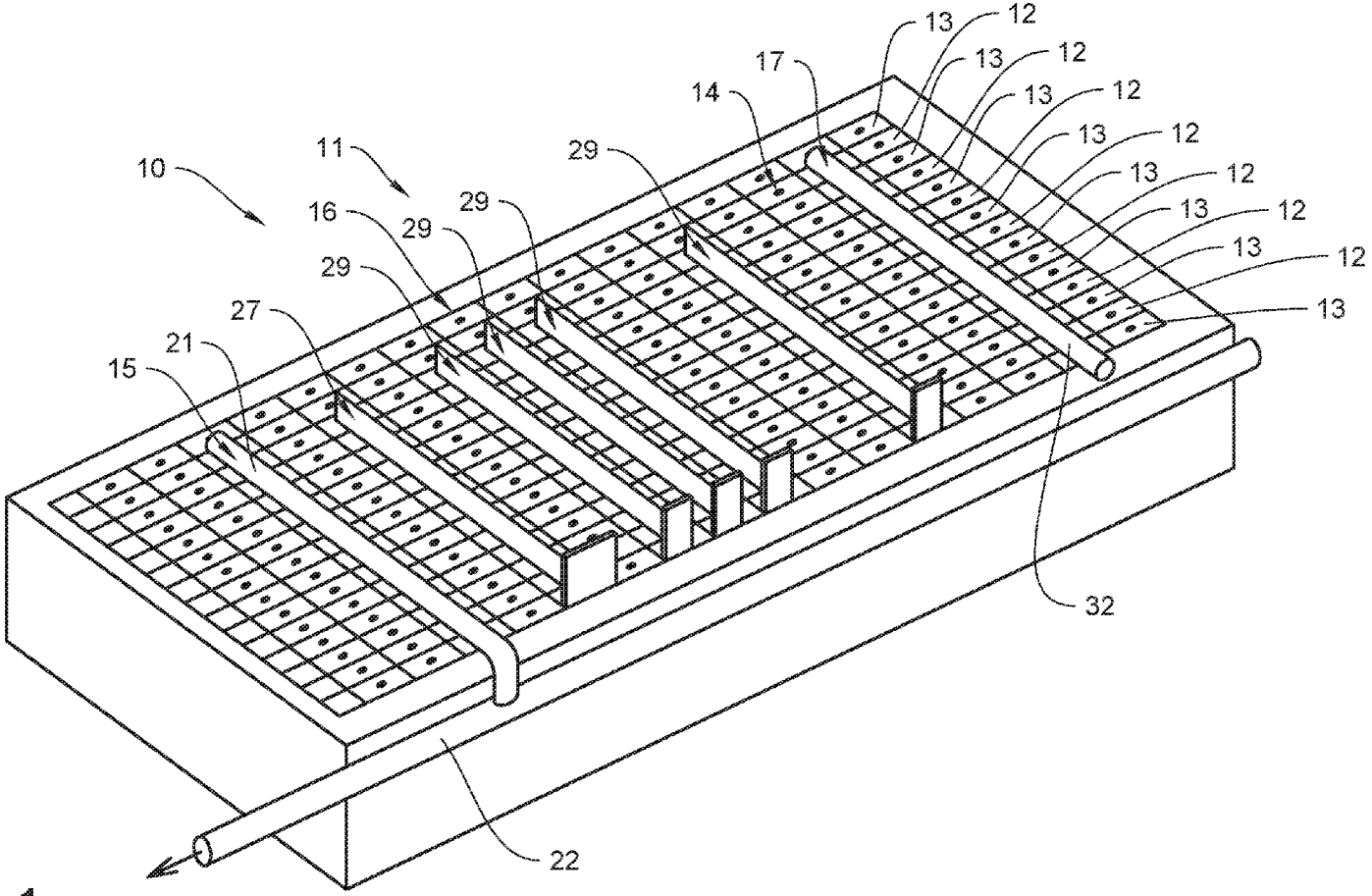
FIG. 1: shows a schematic illustration of an anode furnace in a perspective view.
Figure 2:
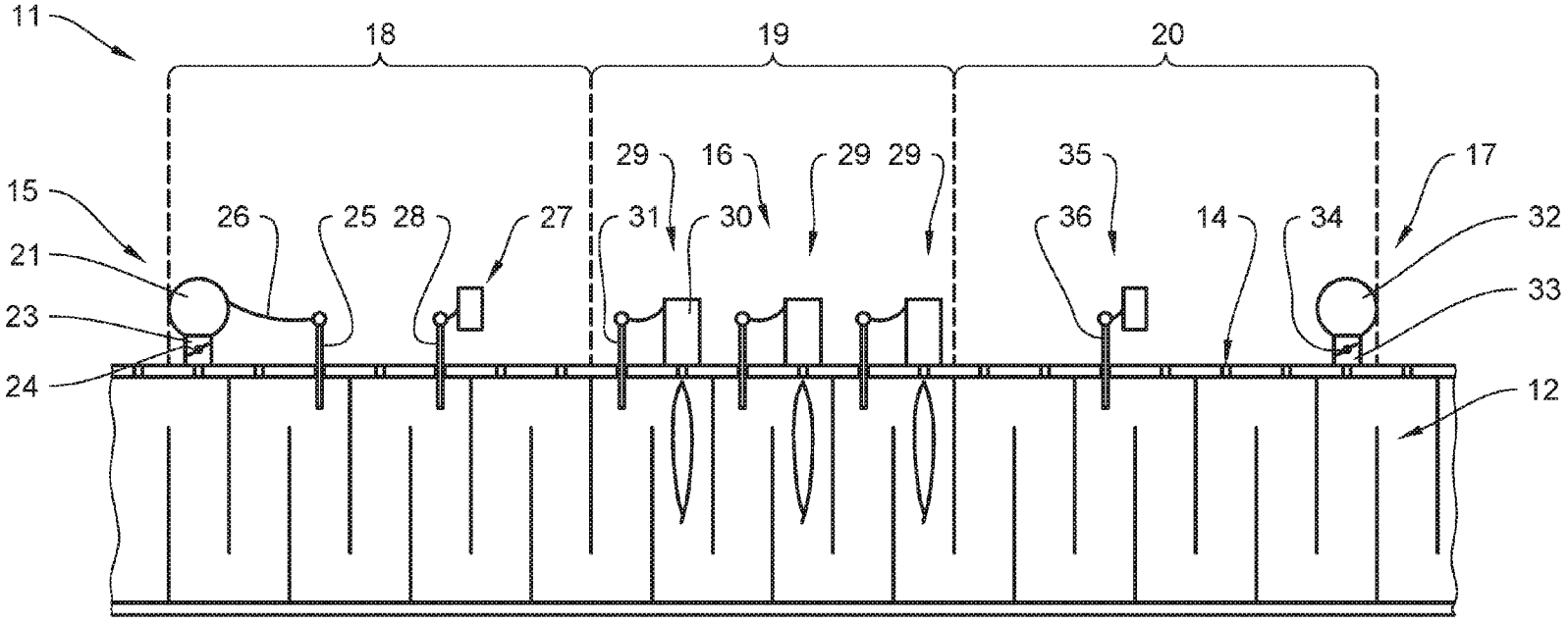
FIG. 2: shows a schematic illustration of a furnace unit of the anode furnace in a longitudinal sectional view.

A combined view of FIGS. 1 and 2 shows a schematic illustration of an anode furnace 10 having a furnace unit 11. The anode furnace 10 includes a plurality of heating ducts 12 which run in parallel along furnace chambers 13 that are located inbetween. In this case, the furnace chambers 13 serve for receiving anodes which are not illustrated in greater detail here. The heating ducts 12, presenting the shape of a meander, run in the longitudinal direction of the anode furnace 10 and have evenly spaced heating duct openings 14, which are respectively covered by a heating duct covering which is not illustrated in greater detail here.

The furnace unit 11 furthermore comprises a suction device 15, a burner device 16 and a blower device 17. Their position at the anode furnace 10 is in each case defined, in a manner conditioned by function, by a heating zone 18, a firing zone 19 and a cooling zone 20. Over the course of the production process of the anodes, the furnace unit 11 is shifted relative to the furnace chambers 13 or to the anodes by tramming the devices 15 to 17 in the longitudinal direction of the anode furnace 10, such that all anodes that are situated in the anode furnace 10 pass through the zones 18 to 20.

The suction device 15 is substantially formed from a collecting duct 21 which is connected to a waste gas cleaning system, which is not illustrated here, via an annular duct 22. The collecting duct 21, in each case via a connecting duct 23, is again connected to a heating duct opening 14, wherein a throttle 24 is arranged at the connecting duct 23 here. A measuring sensor, which is not illustrated here, for measuring the pressure within the collecting duct 21, and a further measuring sensor 25 for measuring the temperature in each heating duct 12 are furthermore directly arranged in front of the collecting duct 21, being connected to the same via a data line 26. In the heating zone 18, in addition, a measuring ramp 27 is arranged having measuring sensors 28 for each heating duct 12. By means of the measuring ramp 27, a pressure and a temperature in the portion in question pertaining to the heating duct 12 can be ascertained.

The burner device 16 comprises three burner ramps 29 having burners 30 and measuring sensors 31 for each heating duct 12. In the heating duct 12 in each case, the burners 30 combust a flammable combustible material, wherein a burner temperature is measured by means of the measuring sensors 31. In this way, it becomes possible to set a desired burner temperature in the range of the firing zone 19.

Figure 3:
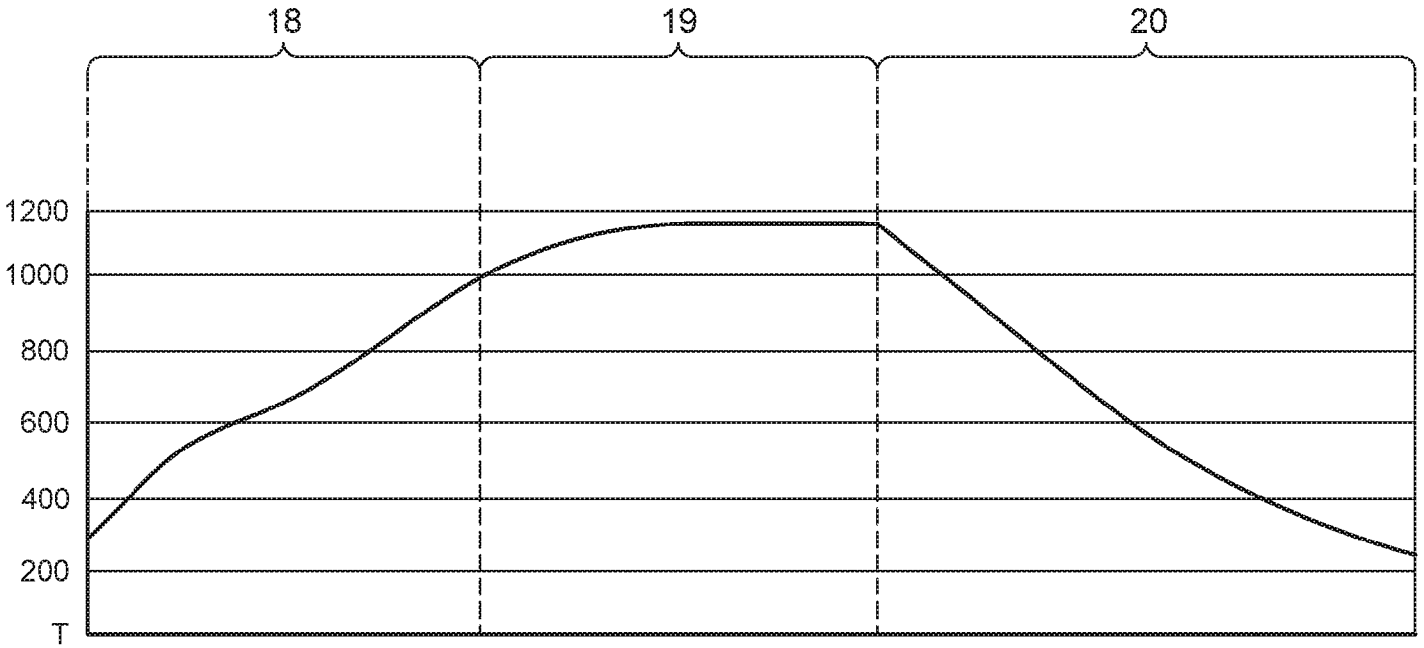
FIG. 3: shows a temperature distribution in the furnace unit.

The cooling zone 20 comprises the blower device 17 which is formed from a feed duct 32 having, in each case, connecting ducts 33 and throttles 34 for connecting to the heating ducts 12. Via the feed duct 32, fresh air is blown into the heating ducts 12. The fresh air cools the heating ducts 12 or the anodes that are situated in the furnace chambers 13 in the range of the cooling zone 20, wherein the fresh air is continuously heated until it reaches the firing zone 19. A chart of the temperature distribution relating to the length of a heating duct 12 and to the zones 18 to 20 can be taken from FIG. 3 in this respect. In the cooling zone 20, a measuring ramp 35 having measuring sensors 36 is furthermore arranged. The measuring sensors 36 serve for recording a pressure in the respective heating ducts 12. In the range of the measuring sensors 36, the pressure in the heating duct 12 essentially reaches the value of zero, wherein a positive pressure is formed between the measuring sensors 36 and the blower device 17 and a negative pressure is formed in the heating ducts 12 between the measuring sensors 36 and the suction device 15. Consequently, the fresh air flows through the heating ducts 12 to the suction device 15, starting from the blower device 17.

Figure 6:
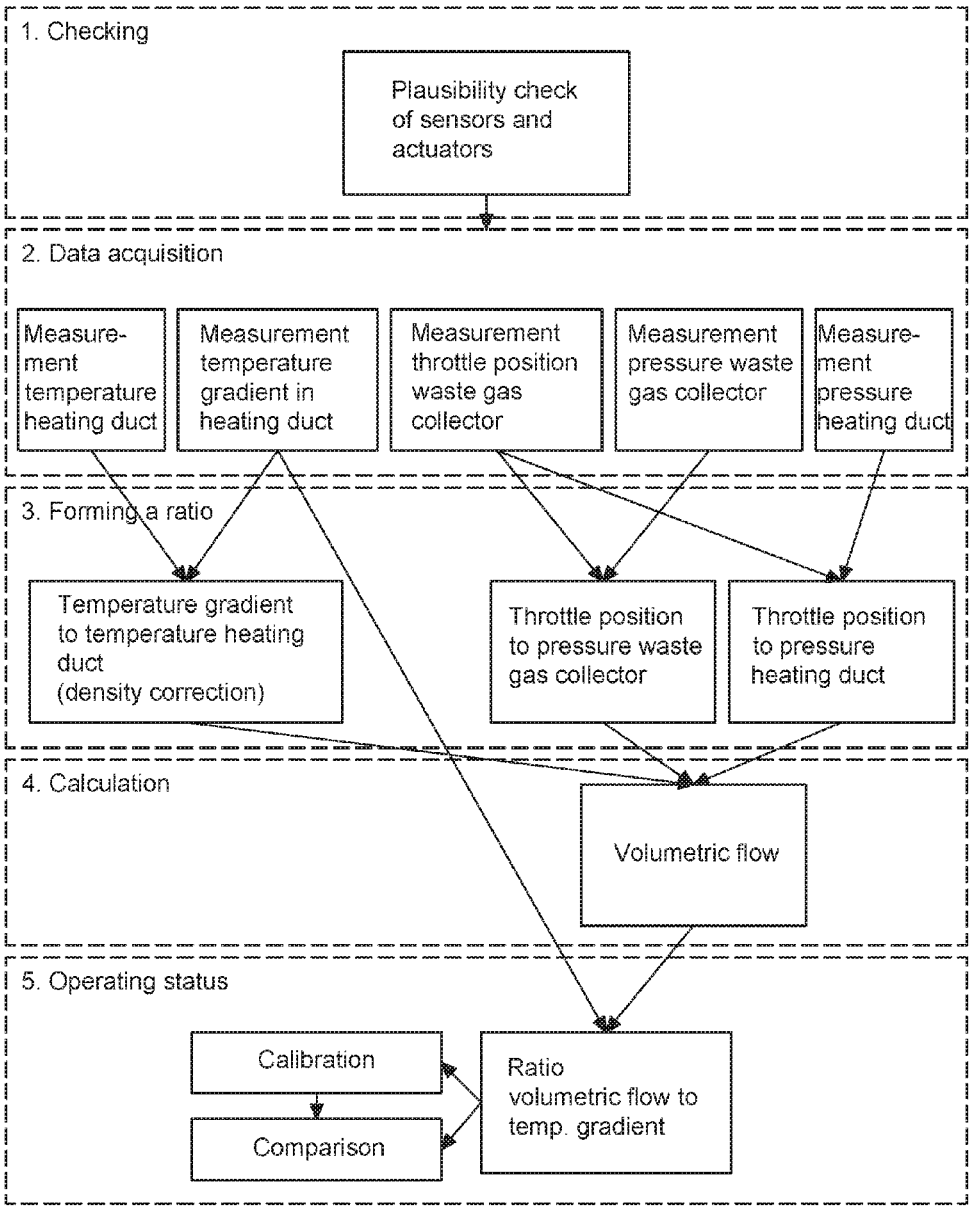
FIG. 6: shows a flow chart for an embodiment of the method for monitoring an operating status.

With the sequence of the method which is illustrated by way of example in FIG. 6, it is now possible to determine a volumetric flow of the air and thus an operating status. Referring to the anode furnace according to FIGS. 1 and 2, all measuring sensors 25, 28, 31, 36 as well as the measuring sensor for determining the position of the throttle 24 of the suction device 15 are tested, the latter sensor not being illustrated here.

In this way, it can be ensured that measurement values of potentially defective measuring sensors are not read out.

Said check is performed directly after tramming the furnace unit 11 and repeatedly initiating the operation of the devices 15 to 17. During operation of the furnace unit 11, a temperature in the heating duct 12 as well as a temperature gradient are recorded by means of the measuring sensor 25 or 28, wherein said measurement values are utilized for correcting the density of the air or hot air that is present in the heating duct 12. In parallel, by means of the measuring sensors 28, a position of the respective throttles 24 is measured, the pressure in the collecting duct 21 is measured and the pressure in the heating ducts 12 is measured. Ratios are formed in each case from the measurement values for the position of the throttle and from the respective measurement values for a negative pressure in the collecting duct 21 and in the heating duct 12, from which ratios a volumetric flow in the heating duct 12 can be derived together with the above-described density correction. An operating status for the volumetric flow is in turn determined from a ratio of volumetric flow and temperature gradient in the heating duct 12. Here, there is provision for storing corresponding measurement values or operating status parameters, thereby calibrating an operating status or describing a proper operating status. During repeating operating phases, it is then possible to perform a comparison between the calibrated or presupposed proper operating status and the current operating status.

Said comparison can, as illustrated in FIG. 4, for example be effected by comparing a current operating pressure at a throttle to a presupposed operating pressure. It is also possible to evaluate a ratio of volumetric flow and temperature gradient, as illustrated in FIG. 5. In the illustrated example, in a range 37 of the chart, the ratio could be evaluated to be proper for the operating status, in a range 38, it could be evaluated to be critical and in a range 39, it could be evaluated to be insufficient. Said operating statuses can, for example, be signaled to an operator as a graphic illustration in the manner of a traffic light indicator or also acoustically.

The invention claimed is:

1. A method for monitoring an operating status of furnace, wherein the furnace is formed from a plurality of heating ducts and furnace chambers, wherein the heating ducts serve for controlling the temperature of the furnace chambers, wherein the furnace includes at least one furnace unit having a heating zone, a firing zone and a cooling zone, wherein a suction device is arranged in the heating zone and a burner device is arranged in the firing zone, said method comprising:

heating combustion air in the heating ducts of the firing zone with the burner device, drawing hot air out of at least one of the plurality of heating ducts in the heating zone using the suction device;

determining a suction output of the suction device by determining a throttle position of a throttle of the suction device;

measuring a pressure in the at least one of the plurality of heating ducts; and determining a ratio of the suction output and pressure, and using the ratio to evaluate the operating status of the furnace.

2. The method according to claim 1, including measuring a pressure in at least one of the heating duct of the heating zone and the firing zone.

3. The method according to claim 2, including measuring a pressure in the suction device.

4. The method according to claim 3, including determining the volumetric flow in heating duct from a ratio of suction output and pressure in the suction device and from the ratio of suction output and pressure in the heating duct.

5. The method according to claim 3, including the step of comparing a respective pressure in at least one of the plurality of heating ducts to the pressure in the suction device.

6. The method according to claim 1, including determining the volumetric flow in the heating duct of at least one of the heating zone and the firing zone.

7. The method according to claim 1, including the step of determining a volumetric flow from the ratio, and using the volumetric flow to evaluate the operating status.

8. The method according to claim 1, including measuring a temperature in the heating duct.

9. The method according to claim 8, including measuring a temperature gradient in the heating duct.

10. The method according to claim 9, including measuring at least one of the temperature gradient and a temperature in at least one of a collecting duct of the suction device, the heating zone, and the firing zone.

11. The method according to claim 9, including calculating a density change of air in the heating duct from the temperature gradient and from the temperature, wherein the density change is used for determining the volumetric flow.

12. The method according to claim 9, including evaluating an operating status from a ratio of temperature gradient and volumetric flow.

13. The method according to claim 7, including evaluating the operating status, wherein, in case of a deviation from a presupposed operating status, the burner device is switched off.

14. The method according to claim 13, in which operating status parameters that describe the operating status are stored, said method further including evaluating the current operating status by comparing stored operating status parameters to the current ones.

15. The method according to claim 1, including performing, before the initiation of operation of the furnace unit, a test of measuring sensors.

* * * * *